US010575577B2

(12) United States Patent
Jackson

(10) Patent No.: US 10,575,577 B2
(45) Date of Patent: Mar. 3, 2020

(54) HEAD SUPPORT SYSTEM

(71) Applicant: Walter Jackson, Littleton, CO (US)

(72) Inventor: Walter Jackson, Littleton, CO (US)

( * ) Notice: Subject to any disclaimer, the term of this patent is extended or adjusted under 35 U.S.C. 154(b) by 0 days.

(21) Appl. No.: 16/425,358

(22) Filed: May 29, 2019

(65) Prior Publication Data

US 2019/0313724 A1 Oct. 17, 2019

Related U.S. Application Data

(63) Continuation-in-part of application No. PCT/US2017/061724, filed on Nov. 15, 2017.

(60) Provisional application No. 62/430,122, filed on Dec. 5, 2016.

(51) Int. Cl.
*A42B 1/24* (2006.01)
*A47C 7/38* (2006.01)

(52) U.S. Cl.
CPC ..... *A42B 1/24* (2013.01); *A47C 7/383* (2013.01)

(58) Field of Classification Search
CPC . Y10T 24/1394; Y10T 24/33; Y10T 24/2708; A42B 1/24; A47C 7/383
USPC ..... 24/303, 442–452
See application file for complete search history.

(56) References Cited

U.S. PATENT DOCUMENTS 5,927,579 A * 7/1999 Schwabe ..... A45F 5/02 224/269
8,381,359 B1 * 2/2013 McArdle ..... A45F 5/02 2/209.13
2016/0198810 A1 * 7/2016 Kaikou ..... A44B 18/0023 24/448

* cited by examiner

*Primary Examiner* — Robert Sandy
(74) *Attorney, Agent, or Firm* — Fennemore Craig, P.C.

(57) ABSTRACT

A head support system may include a clip having a front member, a back member, and a joining member. The joining member of the clip connects the front and back members so that the front, back, and joining members define a U-shaped channel therebetween that is sized to receive a portion of the article of head wear. A first attachment member is mounted to the back member of the clip. A second attachment member is releasably engageable with the first attachment member so that when the first and second attachment members are engaged with one another they provide a holding force in a range of about 5.3-42.7 N. An adhesive provided on a back side of the second attachment member mounts the second attachment member to a seat back.

28 Claims, 11 Drawing Sheets

HEAD SUPPORT SYSTEM

CROSS-REFERENCE TO RELATED APPLICATIONS

This application is a continuation-in-part of co-pending International Application No. PCT/US2017/061724, with an international filing date of Nov. 15, 2017, which claims the benefit of U.S. Provisional Patent Application No. 62/430,122, filed on Dec. 5, 2016, both of which are hereby incorporated herein by reference for all that they disclose.

TECHNICAL FIELD

The present invention relates to head support systems in general and more particularly to support systems for supporting the head while seated in an upright position.

BACKGROUND

Numerous types of head support systems are known and may be used to assist in supporting the head of a user while seated, for example, while sleeping on aircraft, buses, and the like. Unfortunately, many such systems work better in theory than in practice. For example, many head support systems involve the use of straps, tethers, and lanyards that are not only difficult and cumbersome to set up and adjust but also quite obvious in use and indiscrete. Furthermore, once set up and adjusted, many such systems do not permit the user to easily disengage and re-engage the support system, such as required if the user decides to subsequently leave the seat for a short period of time. While other systems have been developed that do not require the use of straps or lanyards, they typically require specialized fixtures or components that are also difficult to use and often not comfortable for the user. As a consequence, such prior art head support systems have never enjoyed widespread use and consumer acceptance.

SUMMARY OF THE INVENTION

One embodiment of a head support system according to the teachings of the invention may include a clip having a front member, a back member, and a joining member. The joining member of the clip connects the front and back members so that the front, back, and joining members define a U-shaped channel therebetween that is sized to receive a portion of an article of head wear. The head support system also includes first and second attachment members. The first attachment member is mounted to the back member of the clip, whereas the second attachment member is releasably engageable with the first attachment member so that when the first and second attachment members are engaged with one another they provide a holding force in a range of about 5.3 N-42.7 N. An adhesive provided on a back side of the second attachment member is usable to mount the second attachment member to a seat back.

Another embodiment of a head support system may include a clip having a front member and a back member joined together so that the front and back members define a U-shaped channel therebetween that is sized to receive a portion of the article of head wear therein. A first attachment is member mounted to the back member of the clip. A second attachment member is releasably engageable with the first attachment member. An adhesive deposited on a back side of the second attachment member is usable to releasably mount the second attachment member to a seat back.

Also disclosed is a method of supporting a head of a user while the user is seated that includes the steps of: Providing a clip that is releasably engageable with an article of head wear to be worn by the user, the clip having first and second attachment members mounted thereto, the first attachment member being mounted to the clip, the second attachment member being releasably engaged with the first attachment member, the second attachment member having an adhesive provided thereon that is covered with an adhesive backing; engaging the clip to the article of head wear; removing the adhesive backing from the second attachment member to expose the adhesive; donning the head wear; and positioning the head at a desired location against a seat back portion of a seat, the adhesive securing the second attachment member to the seat back, the engagement of the first and second attachment members supporting the head of the user while the user remains seated.

Still yet another embodiment of a head support system may include a clip having a front member and a back member joined together so that the front and back members define a U-shaped channel therebetween that is sized to receive a portion of the article of head wear therein. A first attachment member is provided on the back member of the clip. The front side of a second attachment member is releasably engageable with the first attachment member. A support system is configured to engage at least a portion of a seat. An adhesive provided on the back side of the second attachment member is releasably mounts the second attachment member to the support system.

BRIEF DESCRIPTION OF THE DRAWINGS

Illustrative and presently preferred exemplary embodiments of the invention are shown in the drawings in which.

DETAILED DESCRIPTION OF THE PREFERRED EMBODIMENTS

Figure 1:
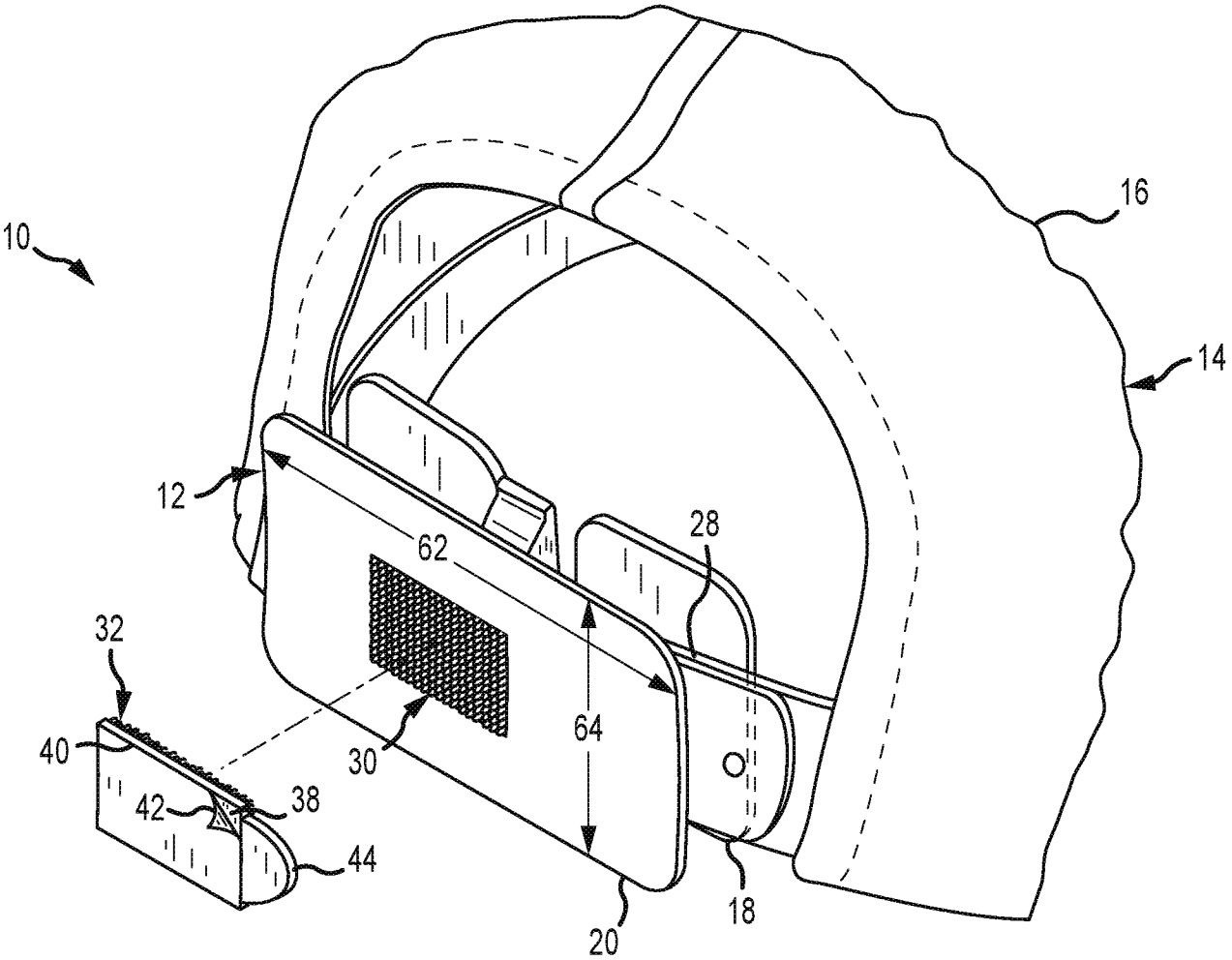
FIG. 1 is a perspective view of one embodiment of the head support system shown engaged to a size adjusting strap on a baseball-type cap and showing the first and second attachment members in a disengaged position.
Figure 2:
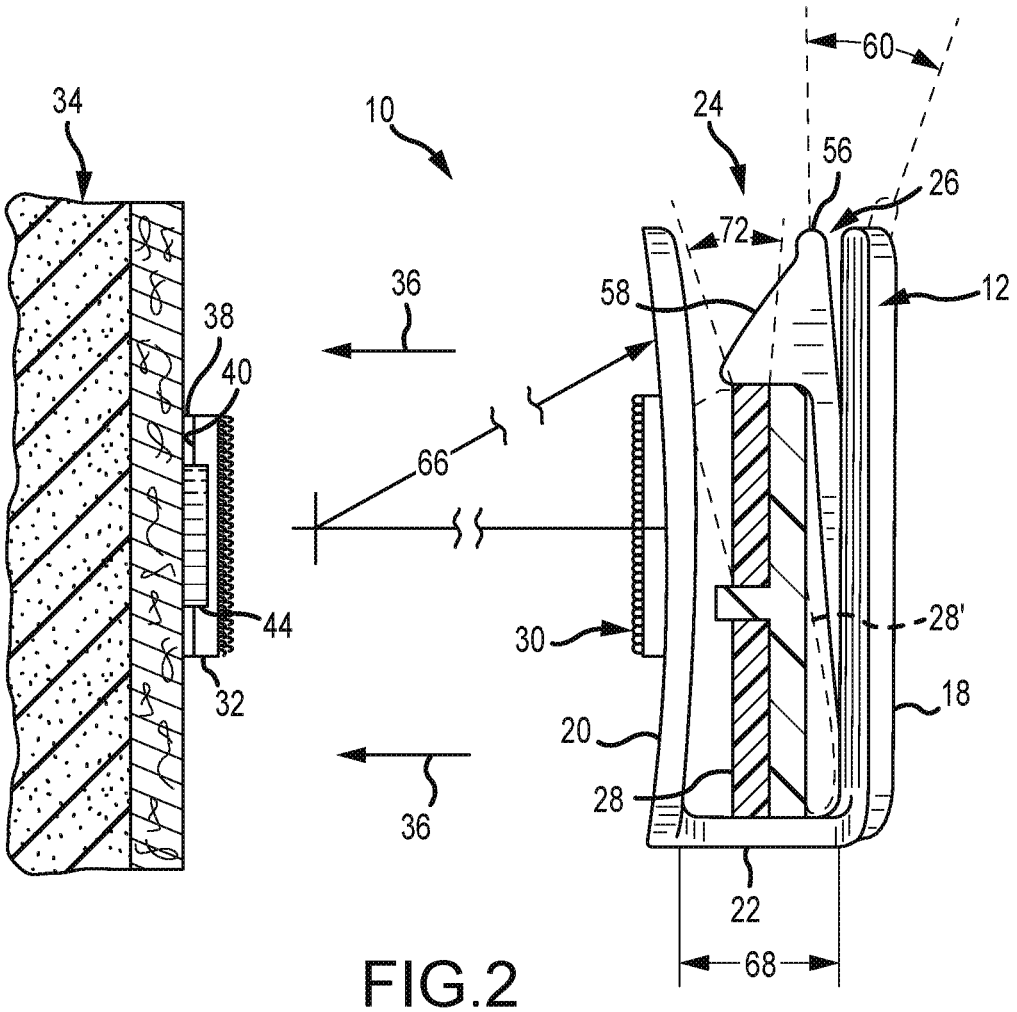
FIG. 2 is an enlarged side view in elevation of the head support system showing the clip engaged with the size adjusting strap on the cap and the second attachment member mounted to a seat back.

One embodiment of a head support system 10 is best seen in FIGS. 1 and 2 and may comprise a clip 12 that is sized to releasably engage an article of head wear 14, such as a baseball-type cap 16, to be worn by a user (not shown). In the particular embodiment shown and described herein, the clip 12 may comprise a front member 18 and a back member 20. The front and back members 18 and 20 are joined or connected together by a joining member 22 so that a U-shaped channel 24 is defined therebetween. U-shaped channel 24 is sized to receive a portion of the article of head wear 14, such as a size adjusting strap 28 of cap 16. In one embodiment, the front member 18 of clip 12 may also define a finger member 26. Finger member 26 is sized to releasably retain the article of head wear 14 when a portion thereof, such as the size adjusting strap 28 of cap 16, is positioned within channel 24.

Head support system 10 may also comprise first and second attachment members 30 and 32 that are releasably engageable with one another. As will be described in greater detail herein, when the first and second attachment members 30 and 32 are engaged with one another, they provide a holding force in a range of about 5.3 to about 42.7 Newtons (N) (about 1.2-9.6 pounds force (lbf)). The first attachment member 30 may be attached or mounted to the back member 20 of clip 12. The second attachment member 32 is configured to be releasably mountable to a seat back 34 so that the second attachment member 32 will be substantially aligned with the first attachment member 30 when the head of the wearer is moved (i.e., in the direction of arrows 36) to a desired position (e.g., for sleeping) against the seat back 34. See FIG. 2. In one embodiment, an adhesive 38 deposited on a back side 40 of second attachment member 32 is used to releasably mount the second attachment member 32 to the seat back 34. The adhesive 38 may be covered by a removable adhesive backing paper 42. As will also be described in greater detail herein, the particular type adhesive 38 as well as the total adhesive area provided on the second attachment member 32 may be selected so that the adhesive 38 continues to adhere the second attachment member 32 to the seat back 34 even when the first and second attachment members 30 and 32 are disengaged from one another. In one embodiment, the second attachment member 32 also may be provided with a tab 44 to allow the user to easily remove the second attachment member 32 from seat back 34 (e.g., by peeling) when second attachment member 32 is no longer needed.

Head support system 10 may be used as follows to support the head of a user (not shown) when the user is seated in a seat. Consider, for example, a scenario wherein the user has been provided with a head support system 10 substantially as described herein, e.g., with the first attachment member 30 attached to clip 12. Although not necessary, the second attachment member 32 may be pre-engaged with the first attachment member 30. That is, the clip 12 and first and second attachment members 30 and 32 all may be attached to one another so that the head support system comprises a single unit. As a next step, the user may engage the clip 12 with the article of head wear 14 which, as mentioned, may comprise a ball-type cap 16. With such a cap 16, the clip 12 may be secured to a size adjusting strap 28 provided on the rear portion of cap 16. The engagement may be accomplished by sliding the size adjusting strap 28 into the U-shaped channel 24 defined by the front and back members 18 and 20 of clip 12. When fully inserted into the channel 24, the finger member 26 retains the size adjusting strap 28 within channel 24, thereby securing the clip 12 to the article of head wear 14. See FIGS. 2 and 3.

Once the clip 12 has been engaged with the article of head wear 14, the user may remove the backing paper 42 from the second attachment member 32 to expose the adhesive 38 provided on the back side 40 of second attachment member 32. The user may then don the head wear 14 and position his or her head at a desired location against seat back 34. The adhesive 38 will securely mount the second attachment member 32 to the seat back 34, thereby allowing the clip 12 engaged thereto to support the head of the user while he or she remains seated. If desired, the user may subsequently disengage the first and second attachment members 30 and 32 by applying a separating force ranging from about 1.8 N to about 49.4 N (about 0.4 lbf to about 11.1 lbf). Such a force will be sufficient to disengage the first and second attachment members 30 and 32 from one another, but not sufficient to detach the second attachment member 32 from seat back 34. Accordingly, the user can readily (and repeatedly) re-engage the first and second attachment members 30 and 32 to provide head support when seated. Thereafter, when the head support system 10 is no longer needed, the user may remove the second attachment member 32 from the seat back 34 by simply pulling on tab 44 to detach the second attachment member 32 from the seat back 34.

A significant advantage of the head support system 10 of the present invention is that it provides a convenient and workable system for supporting the head of a user while seated. The clip 12 is configured to be readily engageable with a wide variety of head wear, is simple and easy to fabricate, and comfortable for the user to wear. In addition, the clip 12 provides a defined but limited degree of movement between the clip 12 and engaged article of head wear, thereby providing for increased comfort during use. That is, the present invention will provide the user with some ability to move his or her head while the system 10 is being used, yet provide sufficient support to allow the user to sleep while seated. The head support system is also discreet, as the various components thereof are comparatively small in size and unobtrusive.

Still other advantages are associated with the first and second attachment members 30 and 32. As briefly described above, the first and second attachment members 30 and 32 are configured to provide a holding force of between about 5.3 and 42.7 N (about 1.2 to about 9.6 lbf) and a release or disengagement force of between about 1.8 N and 49.4 N (about 0.4 lbf to about 11.1 lbf), which provides a good balance between holding force (i.e., a force sufficient to provide the required head support for the user), and the force required to release or disengage the first and second attachment members 30 and 32. The defined holding force range represents a significant aspect of the present invention that has not been recognized by the prior art as being a result-effective variable in the design of such head support systems. That is, I have discovered that the holding force should be within the defined range to provide the correct balance between the holding force required to provide a comfortable degree of head support, while at the same time allowing the user to readily disengage the first and second attachment members 30 and 32 without having to apply excessive force or otherwise feeling uncomfortably constrained by the head support system.

Still other advantages are associated with the type of adhesive and total amount of adhesive surface area that is provided on the back side 40 of second attachment member 32. More specifically, the holding force provided by the adhesive 38 is required to be greater than the force required to disengage the first and second attachment members 30 and 32. Thus, the holding force provided by the adhesive 38 is sufficient to retain the second attachment member 32 to the seat back 34 while the user disengages the first and second attachment members 30 and 32. This aspect allows the user to readily disengage and re-engage the first and second attachment members 30 and 32, but without detaching the second attachment member 32 from the seat back 34. Therefore, the head support system 10 of the present invention provides for greatly enhanced user convenience. Moreover, when the user no longer requires the head support system 10 (e.g., when the flight or bus ride is over), the user can readily remove the second attachment member 32 from the seat back 34 by grasping the tab 44 and peeling the second attachment member 32 from the seat back 34. The holding force provided by the adhesive 38 in relation to the force required to disengage the first and second attachment members 30 and 32 also represents a significant aspect of the present invention that has not been recognized by the prior art as being a result-effective variable in the design of such head support systems.

Having briefly described the head support system 10 of the present invention, as well as some of its more significant features and advantages, various exemplary embodiments of the invention will now be described in detail. However, before proceeding with the description, it should be noted that while the various embodiments of head support system of the present invention are shown and described herein as they could be made from certain materials and used in conjunction with a baseball type of cap to support the head of a user while sleeping, the head support system could be made from other types of materials and used in conjunction with other types of head wear, such as headbands, eye shades, and the like, to provide head support for a user. Consequently, the present invention should not be regarded as limited to the particular materials, types of head wear, and applications shown and described herein.

Also, it should be noted that, as used herein, the terms "holding force" and "release," "separation," or "disengaging force" refer to independent forces. A holding force is one which is holding together the first and second attachment members 30 and 32 despite them being pulled in opposite directions. A release, separation, or disengaging force refers to the attachment members being intentionally separated through user initiation, e.g., by separating them from an edge in a peeling motion. In the particular embodiments shown and described herein, the release, separation, or disengaging force(s) are lower than the holding forces because the attachment members may be separated by a peeling motion.

Referring back now to FIGS. 1-4 simultaneously, one embodiment of the head support system 10 may comprise a clip 12 having a front member 18 and a back member 20. The front and back members 18 and 20 are connected together by a joining member 22 so that clip 12 has a generally U-shaped cross-section, as best seen in FIG. 2. Front member 18 may comprise a generally rectangularly-shaped configuration, although other configurations are possible, some of which are described herein and others of which will become apparent to persons having ordinary skill in the art after having become familiar with the teachings provided herein. If a rectangular configuration is used, front member 18 may have a length 46 ranging from about 1.3 cm to about 20 cm (about 0.5 inches to about 8 inches). A width 48 of rectangularly-shaped front member 18 may range from about 1.3 cm to about 10 cm (about 0.5 inches to about 4 in). The total surface area of front member 18 therefore may be in a range of from about 1.8 $cm^2$ to about 200 $cm^2$ (about 0.25 $in^2$ to about 32 $in^2$). In many embodiments, the total surface area of the front member 18 may be in a range of from about 6.5 $cm^2$ to about 28.9 $cm^2$ (about 1 $in^2$ to about 4.5 $in^2$). In a particular embodiment, the front member 18 may have a length 46 of about 7.6 cm (about 3 in) and a width 48 of about 3.8 cm (about 1.5 in), yielding a total surface area of about 28.9 $cm^2$ (about 4.5 $in^2$).

It is also generally preferred, but not required, that front member 18 be curved in the horizontal direction so as to better conform to the head of the user, thereby improving the overall comfort of the clip 12 when worn. While any of a wide variety of curvatures may be used, in one embodiment the front member 18 may have a radius of curvature 50 (FIG. 3) of about 35.7 cm (about 14 in).

Figure 4:
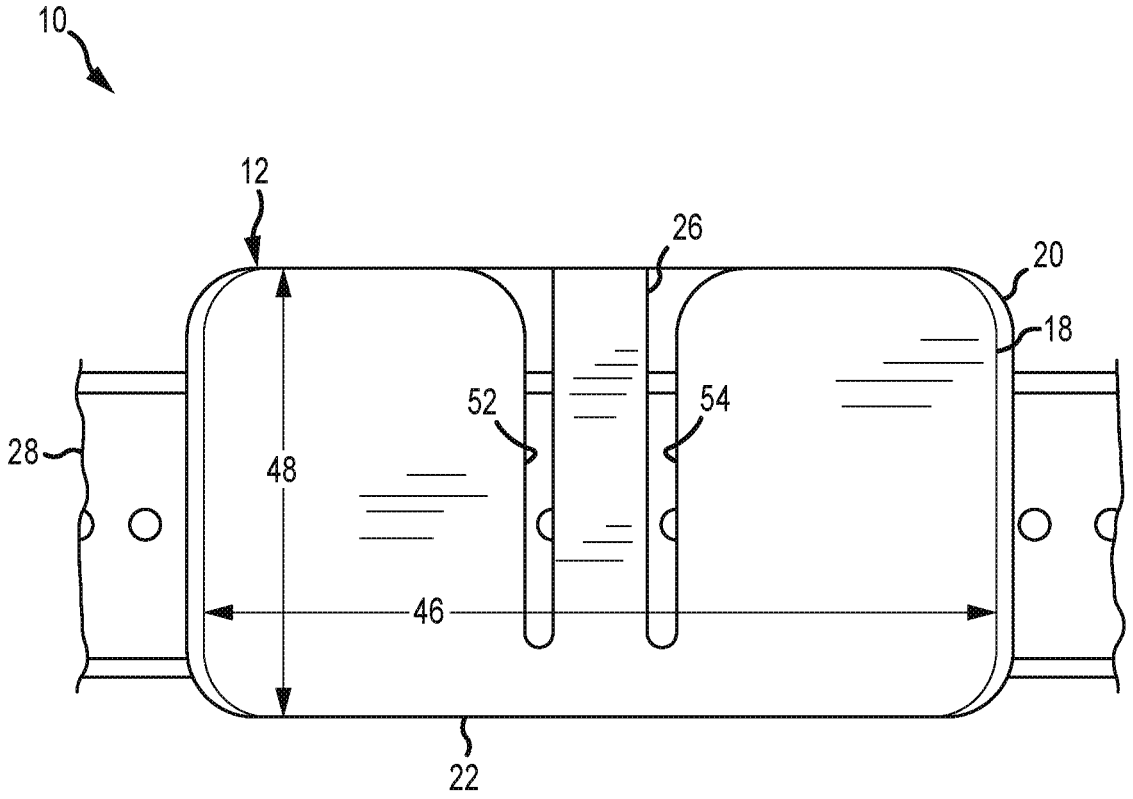
FIG. 4 is a front view in elevation of the clip showing the front and finger members.

Referring now primarily to FIGS. 2 and 4, in one embodiment front member 18 of clip 12 may also define a finger member 26. More specifically, finger member 26 may be defined by a pair of slots 52 and 54 provided in front member 18 of clip 12. A distal end 56 of finger member 26 may be provided with a protrusion or boss 58 configured to retain within channel 24 a portion of the article of head wear 14, such as size adjusting strap 28 of cap 16. Finger member 26 may be biased toward the back member 20 of clip 12, if desired, to enhance the ability of the finger member 26 to reliably retain within channel 24 the portion of the article of head wear 14. In one embodiment, the amount of bias is such that the finger member 26 will release most articles of head wear 14 when the finger member 26 is deflected by an angle 60 of at least about 25° from the undeflected position.

Back member 20 may be similar to front member 18 and may comprise a generally rectangularly-shaped configuration, although a rectangular configuration is not required. In an embodiment wherein the back member 20 comprises a rectangular configuration, back member 20 may have a length 62 ranging from about 1.3 cm to about 20 cm (about 0.5 in to about 8 in) and a width 64 ranging from about 1.3 cm to about 10 cm (about 0.5 in to about 4 in). See FIG. 1. The total surface area of back member 20 may thus be in a range of from about 1.8 $cm^2$ to about 200 $cm^2$ (about 0.25 $in^2$ to about 32 $in^2$). In many embodiments, the total surface area of the back member 20 may be in a range of from about 6.5 $cm^2$ to about 28.9 $cm^2$ (about 1 $in^2$ to about 4.5 $in^2$). In one embodiment, the back member 20 may have a length 62 of about 7.6 cm (about 3 in) and a width 64 of about 3.8 cm (about 1.5 in). The surface area of back member 20 thus may be about 28.9 $cm^2$ (about 4.5 $in^2$).

It is generally preferred, but not required, that back member 20 be curved in the vertical direction so as to better conform to most seat backs 34. See FIG. 2. While any of a wide variety of curvatures may be used, in one embodiment the back member 20 may have a radius of curvature 66 of about 15 cm (about 5.9 in).

Joining member 22 of clip 12 serves to connect or join the front and back members 18 and 20 and thereby define channel 24. In one embodiment, the joining member 22 is located along the bottom portions of the front and back members 18 and 20, as best seen in FIG. 2. The size of the joining member 22 is such that the channel 24 has a width 68 ranging from about 1 cm to about 1.1 cm (about 0.4 in to about 0.43 in). This width 68 is sufficient to accommodate most common articles of head wear 14 and also allow the article of head wear 14 to move with respect to the clip 12. That is, the width 68 of channel 24 is sufficient to allow the size adjusting strap 28 to easily slide back and forth within the channel 24, i.e., in the directions indicated by arrows 70. See FIG. 3. In many embodiments, the sliding motion 70 permitted by channel 24 is sufficient to allow the user to rotate his or her head about 20° to either direction (i.e., left or right of a center or straight-ahead position). In some embodiments, the width 68 of channel 24 will also permit movement of the article of head wear 14 about a lateral axis by an angle 72 of at least about 15°. See FIG. 2. As mentioned earlier, such permissive movement strikes a balance between comfort and support not recognized by the prior art.

In one embodiment, clip 12 may comprise a unitary or single piece article molded from any of a wide range of thermoplastic materials that are now known in the art or that may be developed in the future that are or would be suitable for the intended application. Consequently, the present invention should not be regarded as limited to clips 12 fabricated from any particular material. However, by way of example, in one embodiment, the clip 12 is fabricated from a polycarbonate material.

As mentioned, the first and second attachment members 30 and 32 are releasably engageable with one another so that when engaged they develop a holding force in a range of about 5.3 to about 42.7 N (about 1.2 lbf to about 9.6 lbf) and a release force in a range of about 1.8 to about 49.4 N (about 0.4 lbf to about 11.1 lbf). In one embodiment, the first and second attachment members 30 and 32 may comprise any of a wide range of hook and loop type fastening systems that are readily commercially available. By way of example, in one embodiment, the first and second attachment members 30 and 32 comprise a hook and loop fastening material sold under the brand "Velcro," which is a registered trademark of Velcro Industries, B.V., as product number 90593.

In this regard it should be noted that different types of hook and loop fastening materials have different holding forces per unit area of material. Accordingly, the engageable area of the hook and loop fastening material should be selected so as to provide the first and second attachment members 30 and 32 with a holding force within the range specified herein. By way of example, in an embodiment wherein the hook and loop material comprises product number 90593 sold under the Velcro® brand, the engageable area of the hook and loop material comprising the first and second attachments members 30 and 32 should be in a range of about 6.5 $cm^2$ to about 28.9 $cm^2$ (about 1 $in^2$ to about 4.5 $in^2$).

Moreover, while it is generally preferred that each of the first and second attachment members 30 and 32 be of the same size (e.g., in terms of exposed engageable surface area), there is no requirement that both the first and second attachment members 30 and 32 be of the same size. So long as the engageable surface area of the two members 30 and 32 is sufficient to provide holding and release forces within the desired ranges specified herein, one or the other of the first and second attachment members 30 and 32 may have the greater surface area.

The first and second attachment members 30 and 32 may be attached or mounted to their respective surfaces (e.g., the back member 20 of clip 12 or seat back 34) by any convenient means now known in the art or that may be developed in the future. By way of example, in one embodiment, the first attachment member 30 may be mounted or affixed to the back member 20 of clip 12 by means of an adhesive (not shown) having a holding force that is greater than the release force required to disengage the first and second attachment members 30 and 32, as already described. However, in some embodiments it may be preferable to permanently attach the first attachment member 30 to clip 12.

Figure 3:
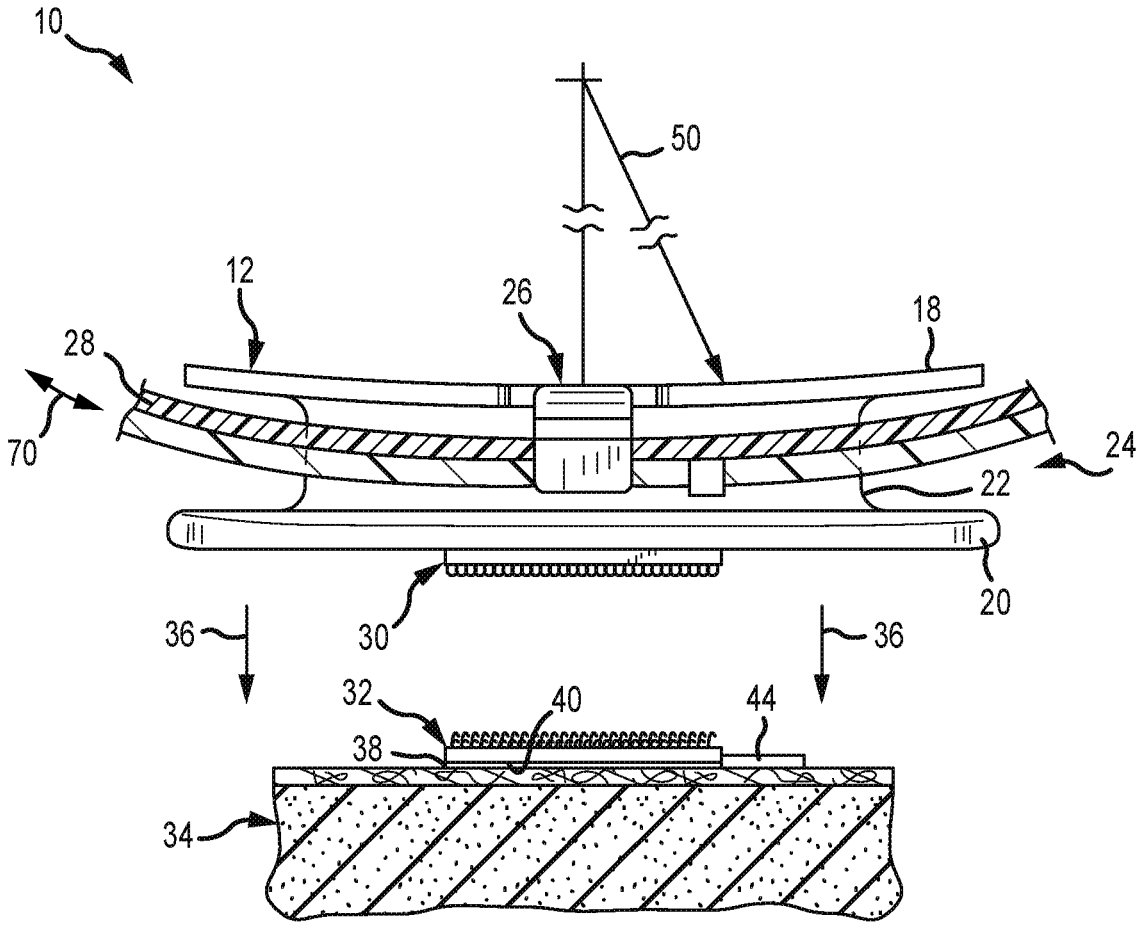
FIG. 3 is an enlarged top view of the head support system showing the clip engaged with the size adjusting strap on the cap and the second attachment member mounted to the seat back.

The second attachment member 32 may be provided with an adhesive 38 provided on the back side 40 thereof, as best seen in FIGS. 1-3. The adhesive 38 may be covered by a backing paper 42 to preserve the integrity of the adhesive 38 until the head support system 10 is ready for use. As mentioned earlier, the type of adhesive 38 as well as its exposed surface area should be selected so that adhesive 38 will adhere the second attachment member 32 to the seat back 34 with a force that is greater than the force required to separate the first and second attachment members 30 and 32 for most common types of seat back cover materials (e.g., vinyls and fabrics).

The adhesive 38 may cover the entire surface area of second attachment member 32. The holding force developed for any particular adhesive should be greater than the holding force developed by the first and second attachment members 30 and 32. The exemplary adhesive (e.g., Velcro® product no. 90593) consistently provided a higher tensile or pull force than the peel force (on attaching member or adhesive) for any given surface area specified herein, thereby allowing the attachment members 30 and 32 to be disengaged by peeling first. Of course different types of adhesives may require different surface areas to provide the desired forces specified herein.

Figure 5:
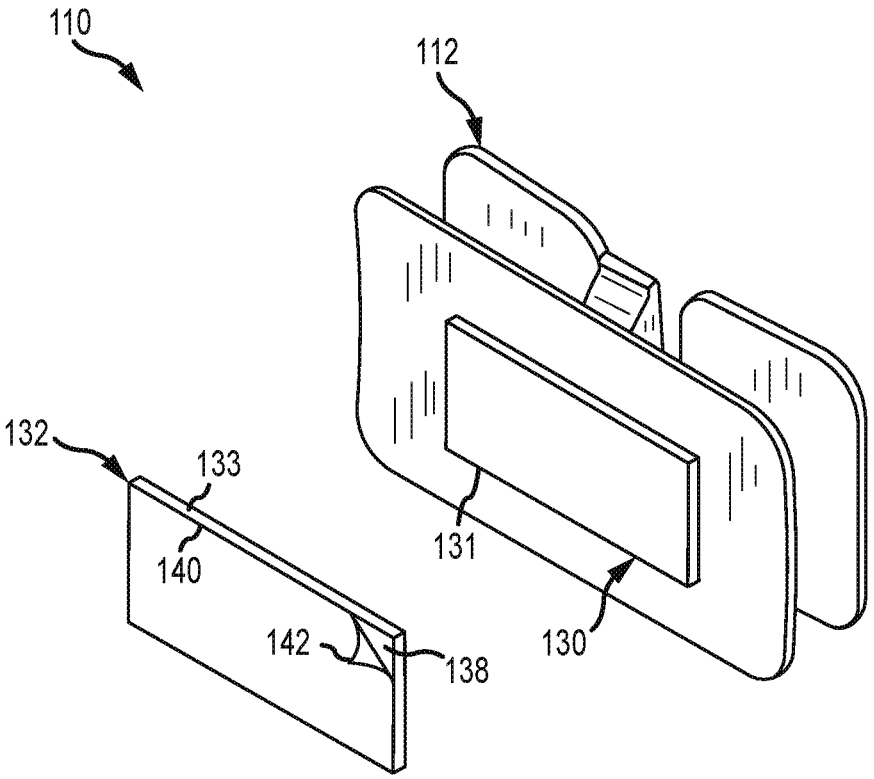
FIG. 5 is a perspective view of a second embodiment of the head support system wherein the first and second attachment members comprise a magnet and a ferromagnetic plate, respectively.

The first and second attachment members 30 and 32 may comprise other types of engageable fasteners besides the hook and loop fasteners already described. For example, and with reference now to FIG. 5, another embodiment 110 of the head support system may involve magnetic means for allowing first and second attachment members 130 and 132 to be releasably engaged from one another. More specifically, in the particular embodiment illustrated in FIG. 5, the first attachment member 130 may comprise a magnetic material 131 mounted to clip 112. The second attachment member 132 may comprise a ferromagnetic material 133. A back side 140 of the second attachment member 132 may be provided with a suitable adhesive 138 thereon to allow the second attachment member 132 to be releasably adhered to a seat back in the manner already described. The adhesive 138 may be covered by a backing paper 142 to protect the adhesive 138 until the second attachment member 132 is ready to be secured to the seat back.

The type and sizes of the magnetic means should be selected to provide a holding force within the range specified herein, i.e., from about 5.3 N to about 42.7 N, and a release or disengagement force ranging from about 1.8 to about 49.4 N. By way of example, in one embodiment, the magnet 131 comprising the first attachment member 130 may comprise a rare earth magnet, such as a neodymium-iron-boron or samarium-cobalt magnet. The second attachment member 132 may comprise a magnetic stainless steel plate. Alternatively, other types of materials are possible and may be used as would become apparent to persons having ordinary skill in the art after having become familiar with the teachings provided herein.

Figure 6:
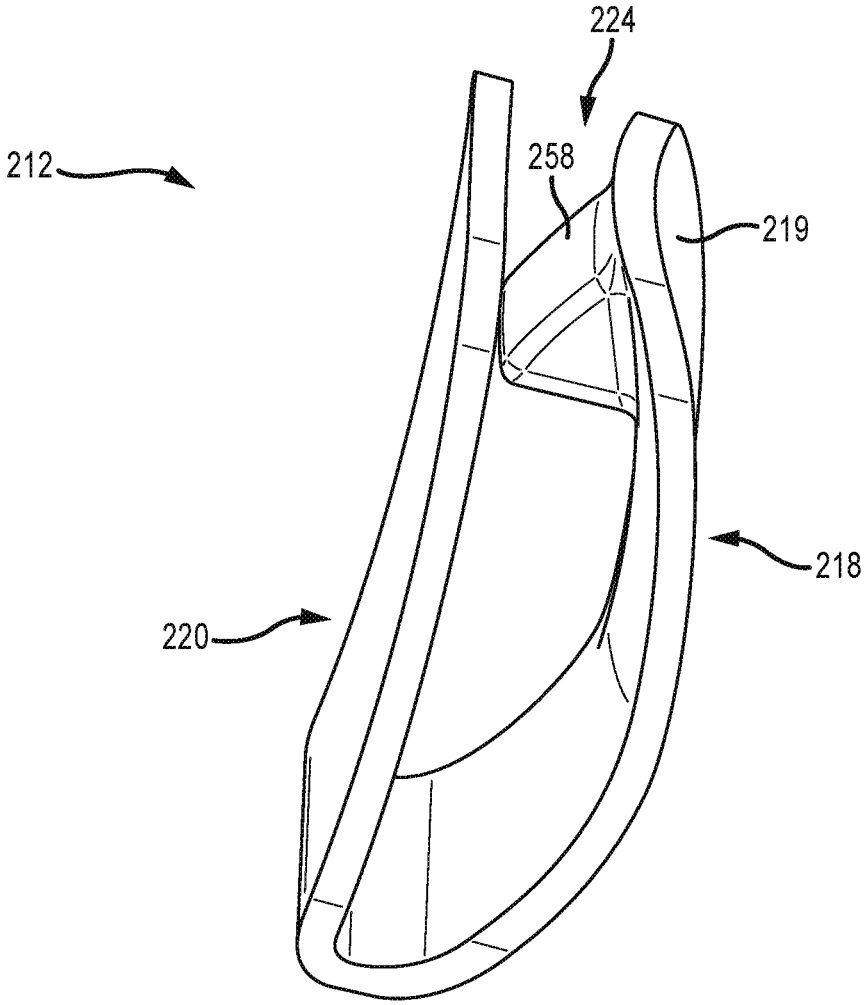
FIG. 6 is a perspective view of another embodiment of a clip without a finger portion.

The clip 12 of head support system may comprise other shapes and configurations. For example, another embodiment of a clip 212 is illustrated in FIG. 6 and may comprise a front member 218 and a back member 220 that are joined together to define a U-shaped channel 224 therebetween. The overall shape of the clip 212 is such that the front and back members 218 and 220 merge together and connect the two without the presence of a separately identifiable joining member (e.g., joining member 22 shown in FIG. 2), although the bottom of the U-shaped channel 224 may be regarded as a member that joins together the front and back members 218 and 220. In the particular embodiment shown in FIG. 6, front member 218 may be curved in both the horizontal and vertical directions so that the front member 218 of the clip 212 defines a front surface 219 having an anticlastic curvature. The back member 220 of clip 212 may be curved in the vertical direction, as is the case for the first embodiment of clip 12. The radii of curvature of the front and back members 218 and 220 may be the same as those specified for the first embodiment 12, although they could be provided with different curvatures. Also in the second embodiment, the front member 218 of clip 212 may define a boss 258 at an upper portion thereof. The boss 258 may be sized to releasably retain the article of head wear (not shown in FIG. 6) when a portion of the article of head wear is positioned in the U-shaped channel 224 of clip 212.

Figure 7:
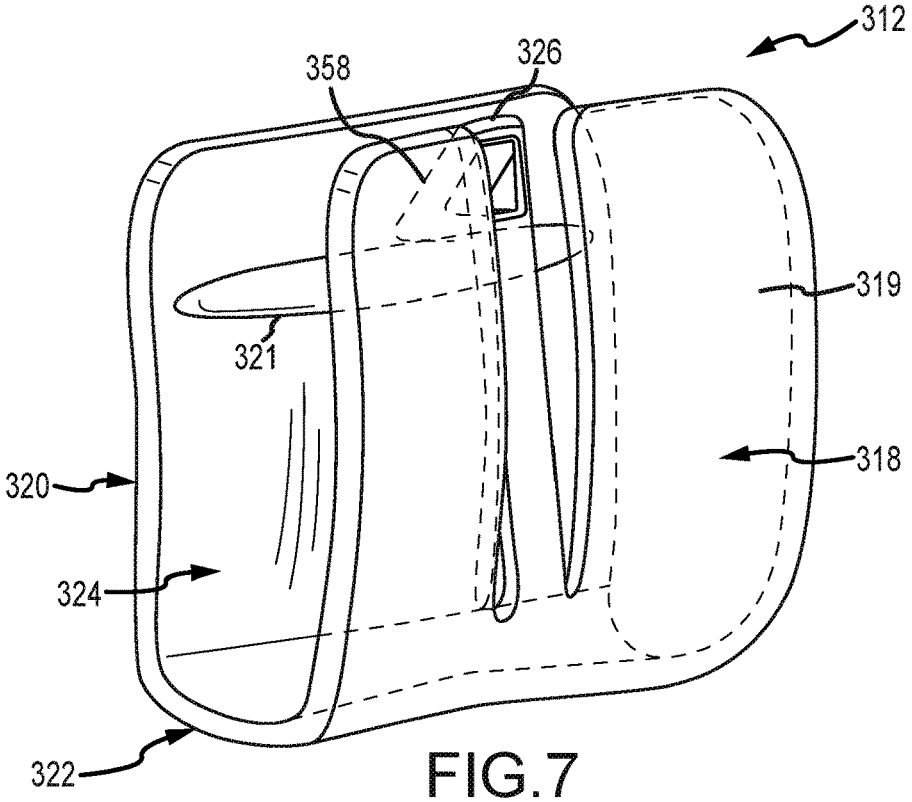
FIG. 7 is a perspective view of yet another embodiment of a clip having a raised rib positioned adjacent a finger member.
Figure 8:
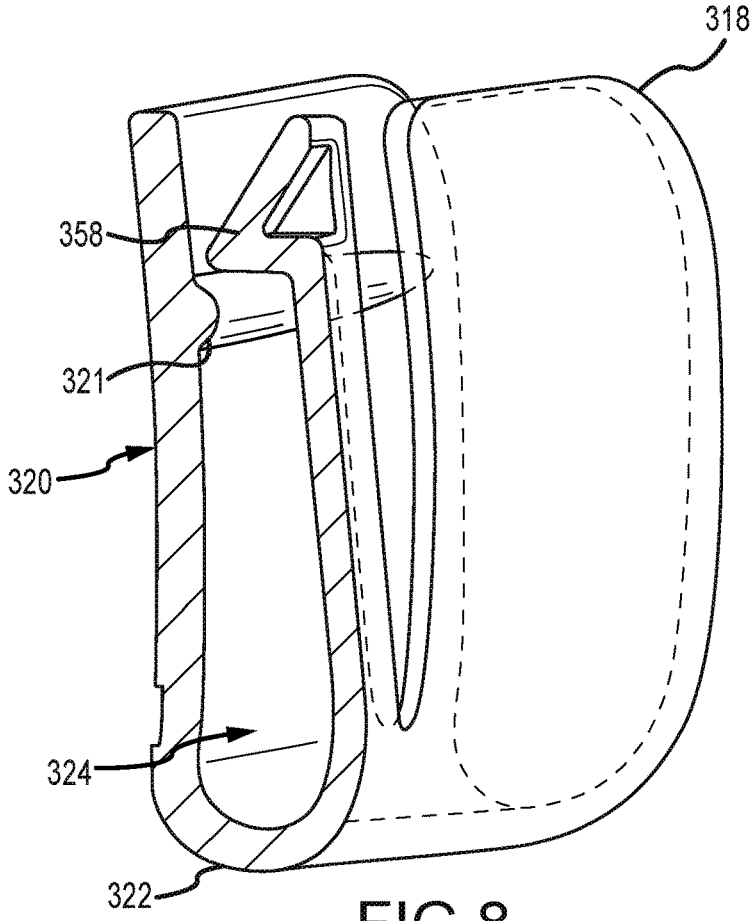
FIG. 8 is a sectional view of the clip illustrated in FIG. 7 more clearly showing the relative positioning of the raised rib and finger member.
Figure 9:
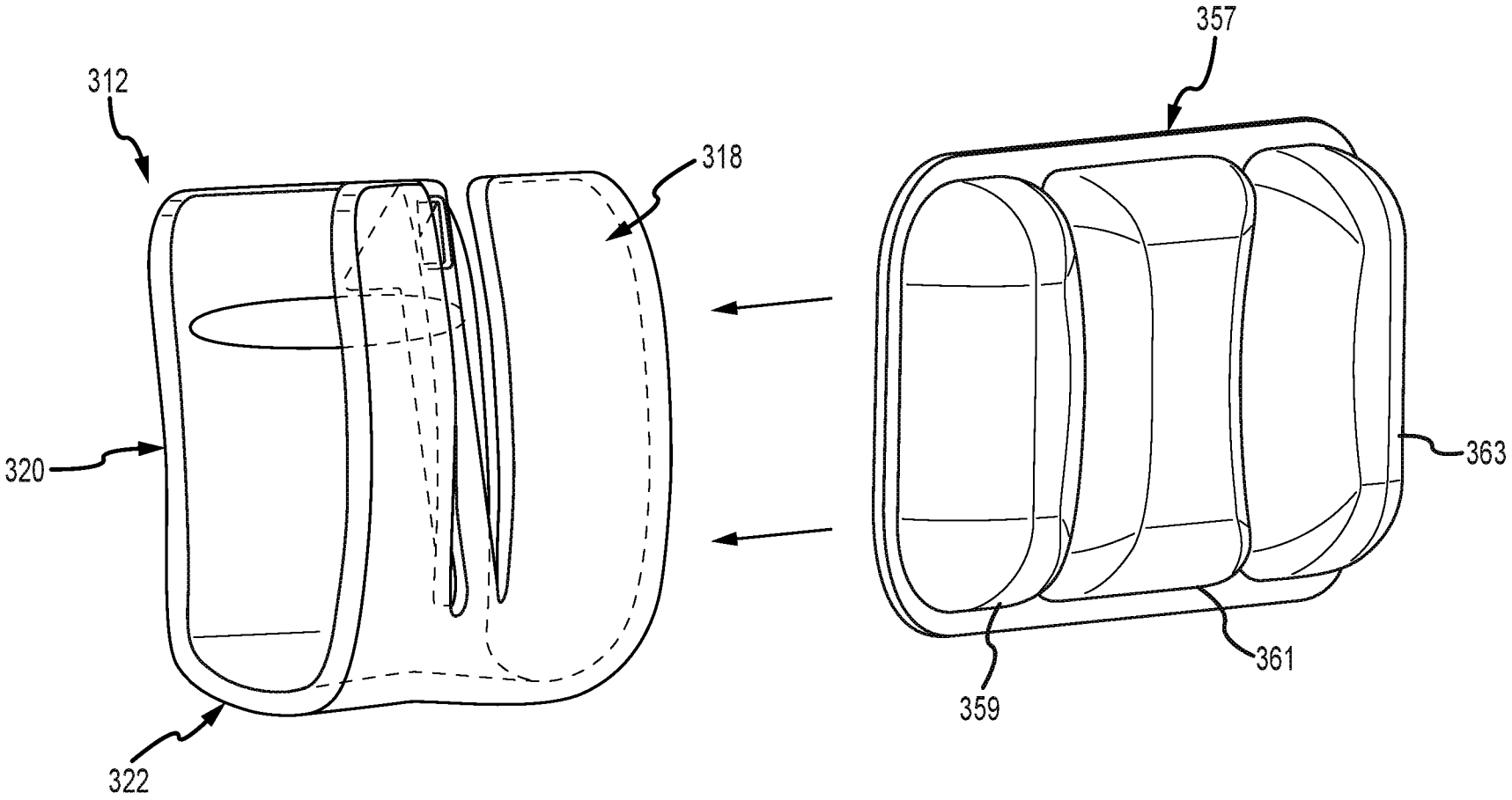
FIG. 9 is an exploded perspective view of the clip illustrated in FIG. 7 having an optional pad mounted to the front member of the clip.

Still other shapes and configurations of the clip member are possible. For example, yet another embodiment 312 of a clip is illustrated in FIGS. 7 and 8 and may comprise a front member 318 and a back member 320 that are joined together by a joining member 322 to define a U-shaped channel 324 therebetween. As was the case for embodiment 212, front member 318 of clip 312 may be curved in both the horizontal and vertical directions so that the front member 318 of clip 312 defines a front surface 319 having an anticlastic curvature. The back member 320 of clip 312 may be curved in the vertical direction, as is the case for the other embodiments. The radii of curvature of the front and back members 318 and 320 may be the same as those specified for the first embodiment 12, although they could be provided with different curvatures. Front member 318 may also define a finger member 326 that is sized to releasably retain the article of head wear when a portion thereof is positioned within U-shaped channel 324. Back member 320 may be provided with a raised rib 321 positioned with respect to a boss 358 provided on finger member 326 so as to enhance the engagement of the article of head wear. If desired, the front portion 318 of clip 312 may be provided with an optional pad 357, as best seen in FIG. 9. Optional pad 357 may be provided with one or more raised areas or 'pillows' 359, 361, and 363, to provide increased comfort. Pad 357 may be fabricated from a foam, sponge rubber, or other type of resilient material and may be adhered, either temporarily or permanently, to the front portion 318 of clip 312. Of course, such an optional pad may be provided to any of the embodiments of the present invention.

Head support system 10 may be used to support the head of a user when the user is seated in a seat. A first step is to provide the user with a head support system 10 as described herein. In one arrangement, the first attachment member 30 may already be attached to clip 12. The second attachment member 32 may be pre-engaged with the first attachment member 30, although such pre-engagement is not required. The user may then engage the clip 12 with the article of head wear 14, such as a baseball cap 16. The clip 12 may be secured to the size adjusting strap 28 provided on the rear portion of cap 16. The engagement may be accomplished by sliding the size adjusting strap 28 into the channel 24 defined by clip 12. When fully inserted into the channel 24, the finger member 26 will retain within channel 24 the size adjusting strap 28, and thereby secure the clip 12 to the article of head wear 14. See FIGS. 2 and 3.

Once the clip 12 has been engaged with the article of head wear 14, the user may remove the backing paper 42 from the second attachment member 32 to expose the adhesive 38 provided thereon. If desired, an optional pad (e.g., pad 357) may be provided on the front member 30 of the clip 12. The user may then don the head wear 14 and position his or her head at a desired location against seat back 34. The adhesive 38 will then securely mount the second attachment member 32 to the seat back 34, thereby allowing the clip 12 to be engaged thereto to support the head of the user while he or she remains seated. Thereafter, the user may disengage the first and second attachment members 30 and 32 by applying a force ranging from about 1.8 N to about 49.4 N. Such a force will be sufficient to disengage the first and second attachment members 30 and 32 from one another, but not sufficient to detach the second attachment member 32 from seat back 34. Accordingly, the user can readily (and repeatedly) re-engage the first and second attachment members 30 and 32 to provide head support when seated. Thereafter, when the head support system 10 is no longer needed, the user may remove the second attachment member 32 from the seat back 34 by simply pulling on tab 44 and peeling the second attachment member 32 from the seat back 34.

Figure 10:
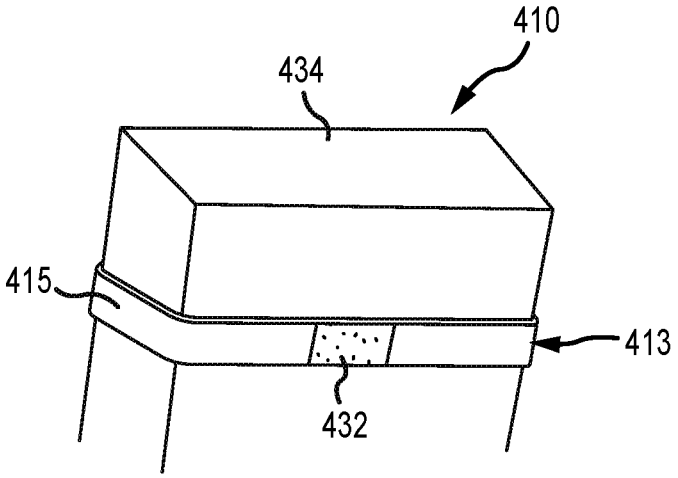
FIG. 10 is a perspective view of another embodiment of a head support system with a strap member for securing around a seat back to receive the clip.
Figure 11:
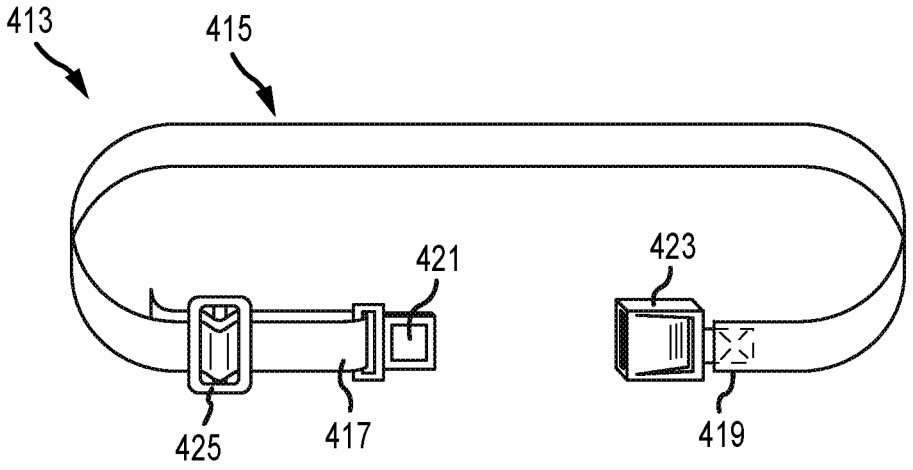
FIG. 11 is a perspective view of the strap illustrated in FIG. 10.

Still other embodiments of the head support system are possible and may be used to advantage in certain situations. For example, and with reference now to FIGS. 10 and 11, another embodiment 410 of the head support system may include a support system 413, such as a strap 415 sized to encircle at least a portion of the seat back 434. Strap 415 allows the various embodiments of the clip 12, 112, 212, and 312 to be secured to a seat back 434 without the need to fasten the second attachment member (e.g., 32) directly to the seat back 434.

Strap 415 may comprise a first end 417 and a second end 419 that can be secured together so that the strap 415 is securely wrapped around seat back 434. In one embodiment a first clip 421 mounted to first end 417 is sized to releasably engage a second clip 423 mounted to second end 419. The first and second clips 421 and 423 allow the strap 415 to be conveniently secured to and released from the seat back 434. Strap 415 may also be provided with a length adjuster 425 to allow strap 415 to fit over seat backs 434 having a wide range of sizes. Strap 415 may also be provided with an attachment member 432 configured to be releasably engaged with attachment member 30 provided on clip 12 (FIG. 1), to allow clip 12 to be releasably secured to strap 415 in the manner already described for attaching the clips, e.g., 12, 112, 212, and 312, directly to a seat back 34.

Strap 415 may be fabricated from any of a wide range of materials, such as nylon fabric, that would be suitable for the intended application. If so, the second attachment member 432, such as the "loop" portion of a hook and loop fastening system or the ferromagnetic portion 133 could be secured to the appropriate location on the strap 415. In another embodiment, the entire strap 415 may comprise a fabric material having the loop portion as an integral portion thereof, as is well-known in the art. In still yet another embodiment, one side of strap 415 may comprise the loop portion and the other side the hook portion, in which case the strap 415 can be easily secured to the seat back 34 by simply wrapping the strap 415 around the seat back 34, then adhering the loop portion to the hook portion. The first and second clips 421 and 423, as well as length adjustor 425 may comprise any of a wide range of clips and length adjustors now known in the art or that may be developed in the future that are (or would be) suitable for use with the particular material used for strap 415. However, because such clips and length adjustors are well known in the art and could be readily provided by persons having ordinary skill in the art after having become familiar with the teachings provided herein, the first and second clips 421 and 423, as well as length adjustor 425 will not be described in further detail herein.

Figure 12:
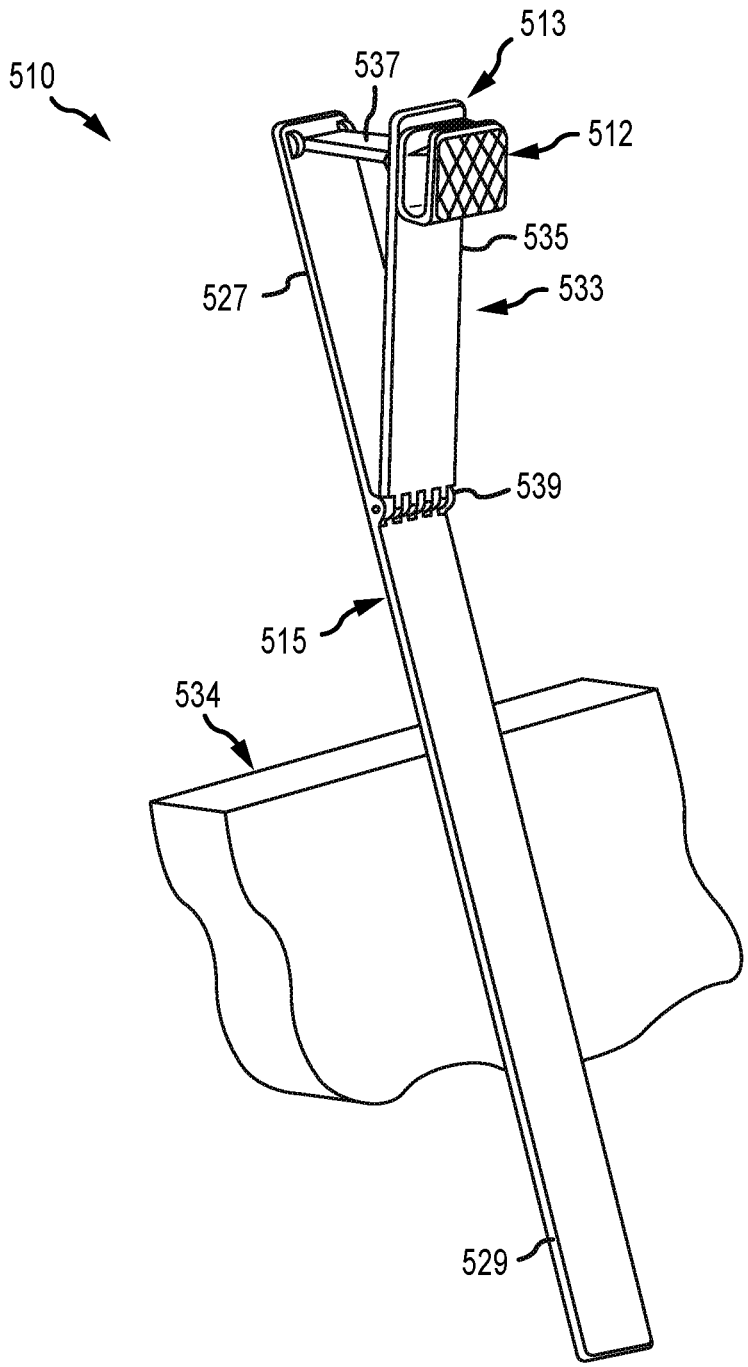
FIG. 12 is a perspective view of still yet another embodiment of a head support system with a support arm for allowing the head support system to be used with low-back seats.
Figure 13:
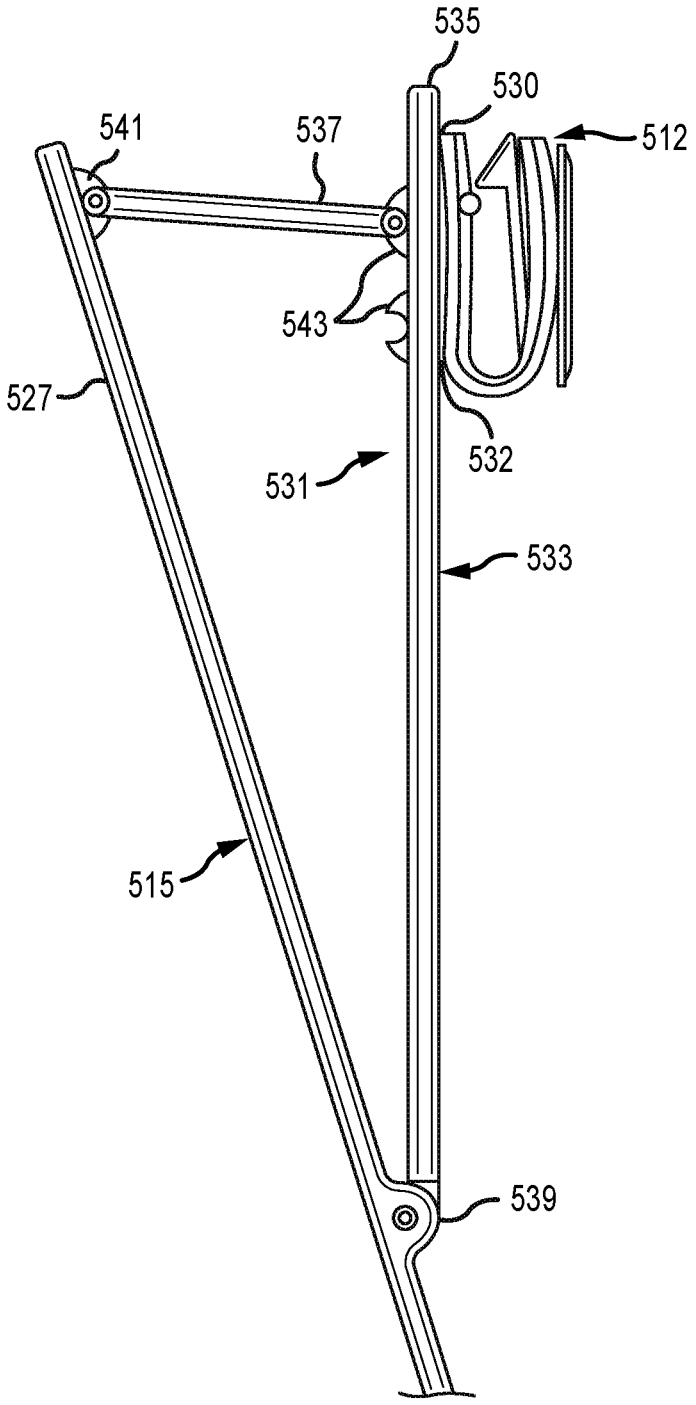
FIG. 13 is an enlarged perspective view of the support arm illustrated in FIG. 12 more clearly showing the arrangement of the adjustable portion of the support arm.

Another embodiment 510 of the head support system is illustrated in FIGS. 12 and 13 allows the head support system 510 to be used in conjunction with a low-rise seat back 534. More specifically, a support system 513 of head support system 510 may comprise an elongate support arm 515 having a proximal end 527 and a distal end 529. Distal end 529 of elongate support arm 515 is adapted to fit between the seat back 534 and the back of a user (not shown) seated in the seat so that the distal end 529 of support arm 515 is securely held therebetween. The proximal end 527 of support arm 515 is adapted to receive any of the various embodiments 12, 112, 212, 312, and 512 of the clips shown and described herein. Support arm 515 allows the various embodiments of the clip 12, 112, 212, 312, and 512 to support the head of the user even with low-rise seat back 534.

With reference now primarily to FIG. 13, proximal end 527 of support arm 515 may comprise an adjustable portion 531 that can be moved between at least a retracted position (not shown) and an extended position 533 (illustrated in FIGS. 12 and 13) to allow the support arm 515 to accommodate a wide range of seat back angles, yet still allow the user to find a comfortable head support position. In one embodiment, the adjustable portion 531 of support arm 515 may comprise a strut member 535 and a spreader member 537. Spreader member 537 is operatively associated with the support arm 515 and the strut 535 and may be used to hold strut 535 at least in the extended position 533. In the particular embodiment shown and described herein, strut member 535 is pivotally mounted to support arm 515 by a hinge assembly 539. Similarly, spreader member 537 may be pivotally mounted to the proximal end 527 of support arm 515 by a hinge assembly 541. Strut member 535 may be provided with one or more clips 543 sized to engage the strut member 535 to allow the spreader member 537 to hold strut member 535 in at least the extended position 533. In embodiments wherein strut member 535 is provided with a plurality of clips 543, then spreader member 537 may hold strut member 535 in other positions intermediate to the extended and retracted positions by simply engaging the spreader member 537 with the appropriate clips 543.

Strut 535 may also be provided with an attachment member 532 configured to be releasably engaged with attachment member 530 provided on clip 512 to allow clip 512 to be releasably secured to strut 535 in the manner already described for the other embodiments. In one embodiment wherein the first and second attachment members 530 and 532 comprise hook and loop fasteners, the hook portion may be integral to the clip 512, in which case the loop portion may be provided on strut 535. Of course, other arrangements are possible, some of which have been shown and described herein and others of which will become apparent to persons having ordinary skill in the art after having become familiar with the teachings provided herein. Consequently, the present invention should not be regarded as limited to the particular system shown in FIGS. 12 and 13 for attaching the clip 512 to strut 535.

Support arm 515 may be fabricated from any of a wide range of materials, such as metals or plastics, that are now known in the art or that may be developed in the future that are (or would be) suitable for the intended application. By way of example, in one embodiment, support arm 515 and the various components thereof, e.g., strut 535 and spreader 537 may be fabricated from a polycarbonate plastic material.

Having herein set forth preferred embodiments of the present invention, it is anticipated that suitable modifications can be made thereto which will nonetheless remain within the scope of the invention. The invention shall therefore only be construed in accordance with the following claims:

The invention claimed is:

1. A head support system, comprising:

a clip having a front member, a back member, and a joining member, the joining member connecting the front and back members so that the front, back, and joining members define a U-shaped channel therebetween that is sized to receive a portion of an article of head wear therein;

a first attachment member mounted to the back member of said clip;

a second attachment member having opposed front and back sides, the front side of said second attachment member being releasably engageable with said first attachment member so that when said first and second attachment members are engaged they provide a holding force in a range of about 5.3-42.7 N; and an adhesive deposited on the back side of said second attachment member, said adhesive being usable to releasably mount said second attachment member to a seat back, wherein said second attachment member comprises a tab portion having a lack of said adhesive provided thereon, said tab portion allowing a user to grasp said second attachment member and remove it from the seat back.

2. The head support system of claim 1, wherein said first and second attachment members comprise a hook and loop fastening system.

3. The head support system of claim 1, wherein said first and second attachment members comprise a magnetic and a ferromagnetic material.

4. The head support system of claim 1, wherein said clip comprises a thermoplastic material.

5. The head support system of claim 4, wherein said thermoplastic material comprises a polycarbonate material.

6. The head support system of claim 1, further comprising a pad mounted to the front member of said clip.

7. The head support system of claim 1, wherein the front member of said clip is curved in a horizontal direction.

8. The head support system of claim 1, wherein the back member of said clip is curved in a vertical direction.

9. The head support system of claim 1, wherein the front member of said clip defines a finger member, the finger member of said clip being sized to releasably engage the article of head wear when a portion of the article of head wear is positioned in the U-shaped channel of said clip.

10. The head support system of claim 9, wherein the finger member is biased toward the back member of said clip.

11. The head support system of claim 9, wherein said finger member comprises a boss located at about a distal end thereof.

12. The head support system of claim 11, further comprising a raised rib provided on the back member of said clip, said raised rib being located adjacent the boss located on the distal end of said finger member.

13. A head support system, comprising:

a clip having a front member and a back member joined together so that the front and back members define a U-shaped channel therebetween that is sized to receive a portion of an article of head wear therein, wherein said front member defines a boss at an upper portion thereof, said boss being sized to releasably engage the article of head wear when a portion of the article of head wear is positioned in the U-shaped channel of said clip;

a first attachment member mounted to the back member of said clip;

a second attachment member having opposed front and back sides, the front side of said second attachment member being releasably engageable with said first attachment member; and an adhesive deposited on the back side of said second attachment member, said adhesive being usable to releasably mount said second attachment member to a seat back.

14. The head support system of claim 13, wherein the front member of said clip is curved in a horizontal direction and a vertical direction so that the front member of said clip defines a front surface having an anticlastic curvature.

15. The head support system of claim 13, further comprising a pad mounted to the front member of said clip.

16. A method of supporting a head of a user while the user is seated in a seat, comprising:

providing a clip that is releasably engageable with an article of head wear to be worn by the user, the clip having first and second attachments members mounted thereto, the first attachment member being mounted to the clip, the second attachment member being releasably engaged with the first attachment member, the second attachment member having an adhesive deposited thereon that is covered with an adhesive backing;

engaging the clip to the article of head wear;

removing the adhesive backing from the second attachment member to expose the adhesive deposited thereon;

donning the head wear; and positioning the head at a desired location against a seat back portion of the seat, the adhesive securing the second attachment member to the seat back, the engagement of the first and second attachment members supporting the head of the user while the user remains seated.

17. The method of claim 16, further comprising disengaging the first and second attachment members by applying a release force ranging from about 1.8 N to about 49.4 N, the release force being sufficient to disengage the first and second attachments members from one another, but not sufficient to detach the second attachment member from the seat back.

18. A head support system, comprising:

a clip having a front member and a back member joined together so that the front and back members define a U-shaped channel therebetween that is sized to receive a portion of the article of head wear therein;

a first attachment member provided on the back member of said clip;

a second attachment member having opposed front and back sides, the front side of said second attachment member being releasably engageable with said first attachment member;

a support system, said support system being configured to engage at least a portion of a seat; and an adhesive provided on the back side of said second attachment member, said adhesive being usable to releasably mount said second attachment member to said support system.

19. The head support system of claim 18, wherein said support system comprises a strap sized to encircle at least a portion of a seat back.

20. The head support system of claim 19, wherein said strap comprises a first end, a second end, and a length sufficient to encircle a desired portion of the seat back, so that the first end of said strap can be secured to the second end of said strap when said strap encircles the desired portion of the seat back.

21. The head support system of claim 20 further comprising a first clip mounted to the first end of said strap and a second clip mounted to the second end of said strap, said first and second clips being releasably engageable with one another.

22. The head support system of claim 21 further comprising a length adjuster operatively associated with said strap.

23. The head support system of claim 18, wherein said support system comprises an elongate support arm having a proximal end and a distal end, the distal end being adapted to fit between a back of the seat and a back of a user so that the distal end of said elongate support arm is held therebetween, the proximal end of said elongate support arm being sized to receive the back side of said second attachment member.

24. The head support system of claim 23, wherein the proximal end of said elongate support arm comprises an adjustable portion that can be moved between an extended position and a retracted position.

25. The head support system of claim 24, wherein said adjustable portion comprises:

a strut mounted to said elongate support arm so that said strut may be moved between the extended and retracted positions; and a spreader operatively associated with said elongate support arm and said strut, said spreader holding said strut in the extended position.

26. The head support system of claim 25, wherein said spreader is operable to hold said strut in a plurality of positions between the retracted and extended positions.

27. The head support system of claim 26, wherein said strut is pivotally mounted to said support arm and wherein said spreader is pivotally mounted to said support arm.

28. The head support system of claim 27, further comprising a plurality of clips provided on said strut and wherein said spreader is sized to operatively engage selected ones of the plurality of clips to hold said strut in corresponding positions between the retracted and extended positions.

* * * * *